US006761145B2

(12) United States Patent
Matsuda et al.

(10) Patent No.: US 6,761,145 B2
(45) Date of Patent: Jul. 13, 2004

(54) THROTTLE SYSTEM FOR GENERAL-PURPOSE ENGINE

(75) Inventors: Hayato Matsuda, Wako (JP); Sei Watanabe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/418,129

(22) Filed: Apr. 18, 2003

(65) Prior Publication Data

US 2003/0196638 A1 Oct. 23, 2003

(30) Foreign Application Priority Data

Apr. 19, 2002 (JP) ..... 2002-117375
Apr. 19, 2002 (JP) ..... 2002-117376

(51) Int. Cl.[7] ..... F02D 1/00
(52) U.S. Cl. ..... 123/342; 123/400; 123/403
(58) Field of Search ..... 123/342, 400, 123/403, 442

(56) References Cited

U.S. PATENT DOCUMENTS 4,785,691 A * 11/1988 Papenhagen et al. ..... 477/107
4,919,097 A 4/1990 Mitui et al.
5,016,589 A 5/1991 Terazawa
RE34,138 E * 12/1992 Flaig et al. ..... 123/400
5,178,112 A * 1/1993 Terazawa et al. ..... 123/399
5,964,203 A * 10/1999 Sato et al. ..... 123/396
6,463,826 B1 * 10/2002 Bouchillon ..... 74/502.6
6,626,243 B1 * 9/2003 Go Boncan ..... 166/293
6,698,397 B2 * 3/2004 Cook ..... 123/399

FOREIGN PATENT DOCUMENTS

EP 0 536 826 A1 4/1993
JP 5-187287 7/1993
JP 10-047520 2/1998
JP 2001-263098 9/2001

* cited by examiner

*Primary Examiner*—John Kwon
(74) *Attorney, Agent, or Firm*—Westerman, Hattori, Daniels & Adrian, LLP

(57) ABSTRACT

A throttle system for a general-purpose engine, having an actuator (motor) connected to a throttle valve to open or close it so as to regulate amount of intake air. An output transmission mechanism constituted as a link mechanism or a gear mechanism is provided between the actuator and the throttle valve to transmit an output of the actuator to the throttle value such that an output of the mechanism relative to the output of the actuator when the throttle valve is fully closed, is smaller than that when the throttle value is not fully closed. With this, the system can finely open and close the throttle valve when its opening is small and can open and close it at high speed when its opening is large, while preventing throttle valve seizing.

9 Claims, 16 Drawing Sheets

THROTTLE SYSTEM FOR GENERAL-PURPOSE ENGINE

BACKGROUND OF THE INVENTION

1. Field of the Invention

This invention relates to a throttle system for a general-purpose engine, particularly to a general-purpose engine throttle system that is equipped with a throttle valve connected to an actuator to enable control of the amount of intake air supplied to the engine by operating the actuator to open and close the throttle valve.

2. Description of the Related Art

The general-purpose engine is a spark-ignition internal combustion engine that sucks air into the cylinders, ignites and burns an air-fuel mixture produced by mixing gasoline fuel and an amount of intake air regulated by a throttle valve. The engine speed is generally controlled by a throttle system driven by a mechanical governor comprising weights and a spring.

Still, even in this type of general-purpose engine, highly accurate engine speed control has recently been introduced through the use of an electronic governor connected to the throttle valve through a stepper motor, linear solenoid or other such actuator.

Actuator-driven system throttle systems are taught, for example, by Japanese Laid-open Patent Applications No. Hei 10(1998)-47520 and No. 2001-263098. These prior art systems use a motor as the actuator. The output shaft of the motor and the rotating shaft of the throttle valve are connected through gears so as to transmit the motor rotation to the throttle valve.

As shown in FIG. 11, however, the change in amount of intake air (indicated as "Gair") passing through the throttle opening with change in throttle opening increases with decreasing throttle opening (indicated as "θth") and, conversely, decreases with increasing throttle opening. This is because the pressure difference between the upstream and downstream sides of the throttle valve decreases with increasing throttle opening to finally reach a constant minimum value.

In order to follow the desired engine speed with good accuracy and response, therefore, fine throttle valve regulation is required at small throttle opening and high speed throttle valve opening/closing regulation is required at large throttle opening.

Thus, owing to the limited resolution of the motor (stepper motor), the reduction gear ratio must be set high to enable opening and closing of the throttle valve to be performed with finely. On the other hand, the reduction gear ratio must be set low to increase the throttle valve opening/closing speed.

As the reduction gear ratio is constant in the prior art, however, the throttle opening (θth) varies linearly with motor rotation angle (indicated as "θm") as shown in FIG. 12. In the prior art, therefore, an attempt to conduct valve opening/closing finely by setting the reduction gear ratio high runs into the problem that the opening/closing speed becomes so slow as to degrade the engine speed control response when the throttle opening is large.

Conversely, an attempt to increase the throttle valve opening/closing speed by setting the reduction gear ratio low runs into the problem that the fineness of opening/closing at small throttle opening is degraded to the point that accurate control of engine speed becomes impossible. It also encounters the problem that the throttle valve drive torque decreases to the point that throttle valve seizing (sticking) is likely to occur when the throttle opening is small.

SUMMARY OF THE INVENTION

An object of the present invention is therefore is to overcome the aforesaid problems by providing a throttle system for a general-purpose engine that can finely open and close a throttle valve when its opening is small (when pressure difference between upstream and downstream of the throttle valve is large), can open and close the throttle valve at high speed when its opening is large (when pressure difference between upstream and downstream of the throttle valve is small), and can prevent throttle valve seizing.

In order to achieve the foregoing object, this invention provides a throttle system for a general-purpose engine, having an actuator connected to a throttle valve of the engine, the actuator being displaceable to open or close the throttle valve so as to regulate amount of intake air, comprising: an output transmission mechanism provided between the actuator and the throttle valve to transmit an output of the actuator to the throttle value such that an output of the mechanism relative to the output of the actuator when the throttle valve is closed is smaller than that when the throttle value is not closed.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

A throttle system for a general-purpose engine according to a first embodiment of this invention will now be explained with reference to the attached drawings.

Figure 1:
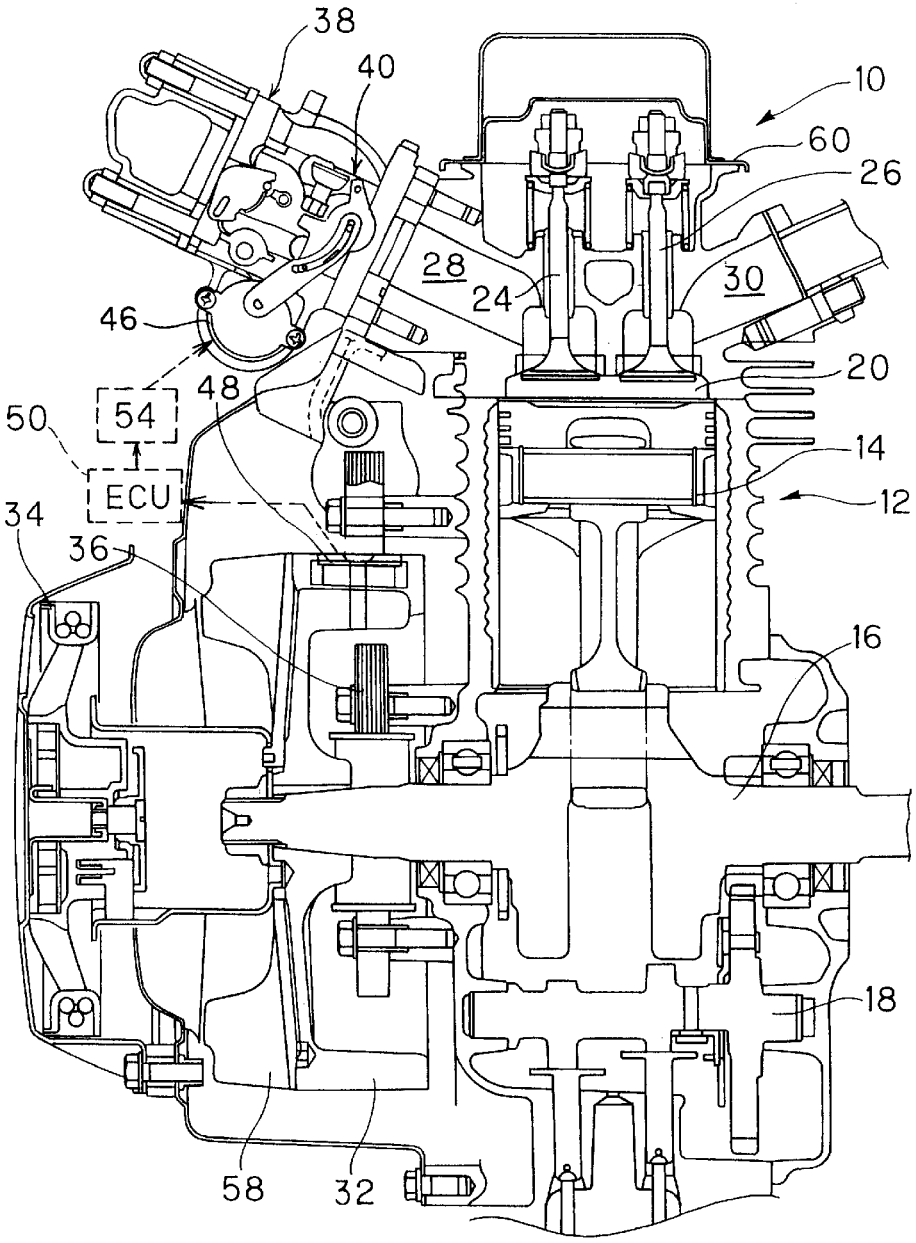
FIG. 1 is an overall schematic diagram showing a throttle system for a general-purpose engine according to a first embodiment of this invention.

FIG. 1 is an overall schematic diagram showing a throttle system for a general-purpose engine according to a first embodiment of this invention.

In FIG. 1, reference numeral 10 designates a general-purpose engine (hereinafter referred to as the "engine"). The engine 10 is an air-cooled, four-cycle OHV model with a displacement of 196 cc. The engine 10 has a single cylinder 12 accommodating a piston 14 that can reciprocate therein. The piston 14 is connected to a crankshaft 16 and the crankshaft 16 is connected to a camshaft 18 through a gear.

A combustion chamber 20 is formed between the head of the piston 14 and the cylinder wall. An intake valve 24 and an exhaust valve 26 are installed in the cylinder wall for opening the combustion chamber 20 to and closing it off from an air intake passage 28 and an exhaust passage 30.

A flywheel 32 is attached to the crankshaft 16 and a recoil starter 34 is attached to the outer side of the flywheel 32 for use by the operator when starting the engine 10. A generator coil (alternator) 36 is installed on the inner side of the flywheel 32 for generating alternating current. The generated alternating current is converted to direct current by a rectifier circuit (not shown) and supplied to a spark plug (not shown) etc.

A carburetor 38 is installed upstream of the air intake passage 28 along with a throttle system 40, formed integrally with the carburetor 38, for regulating the intake air. The carburetor 38 is connected to a fuel tank (not shown) through a fuel line (not shown). It is supplied with gasoline fuel stored in the fuel tank and produces an air-fuel mixture by jetting gasoline fuel into intake air through a nozzle. The so-produced air-fuel mixture flows in the downstream direction of the air intake passage 28 to be sucked into the combustion chamber 20 of the cylinder 12 through the intake valve 24.

The throttle system 40 is connected to a stepper motor (actuator; hereinafter called "motor") 46 supplied with command values (step angles) to operate so as to open/close the throttle valve (not shown in FIG. 1) according to the command values. A crank angle sensor (engine speed sensor) 48 composed of a magnetic pickup is provided in the vicinity of the flywheel 32 and outputs a pulse once every prescribed crank angle.

An encased ECU (electronic control unit) 50 is installed at an appropriate part of the engine 10. The output of the crank angle sensor 48 is sent to the ECU 50. The ECU 50 is constituted as a microcomputer equipped with a CPU, ROM, RAM and a counter. The output pulses of the crank angle sensor 48 are input to the counter in the ECU 50 to be counted and used to calculate (detect) the engine speed.

Based on the detected engine speed etc., the ECU 50 calculates a command value for the motor 46 so as to make the detected engine speed coincide with the desired engine speed, and operates the motor 46 by outputting the command value thereto through a motor driver 54 mounted adjacent to the ECU 50 in the same case. The engine 10 is connected to a load (not shown). Reference numerals 58 and 60 in FIG. 1 designate a cooling fan and a head cover.

The engine speed of the engine 10 is thus controlled by an electronic governor equipped with the generator coil 36, the throttle system 40, the motor 46, the crank angle sensor 48, the ECU 50 and the motor driver 54.

Figure 2:
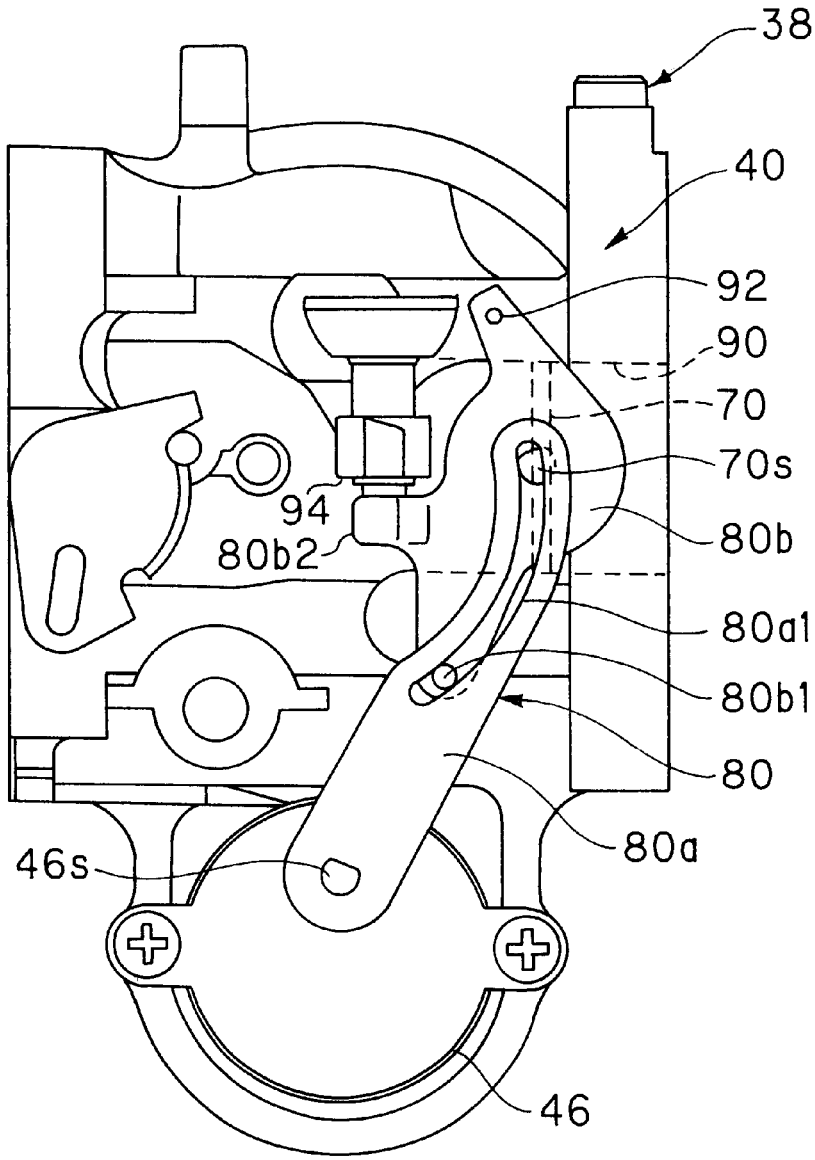
FIG. 2 is a front view of the throttle system illustrated in FIG. 1.
Figure 3:
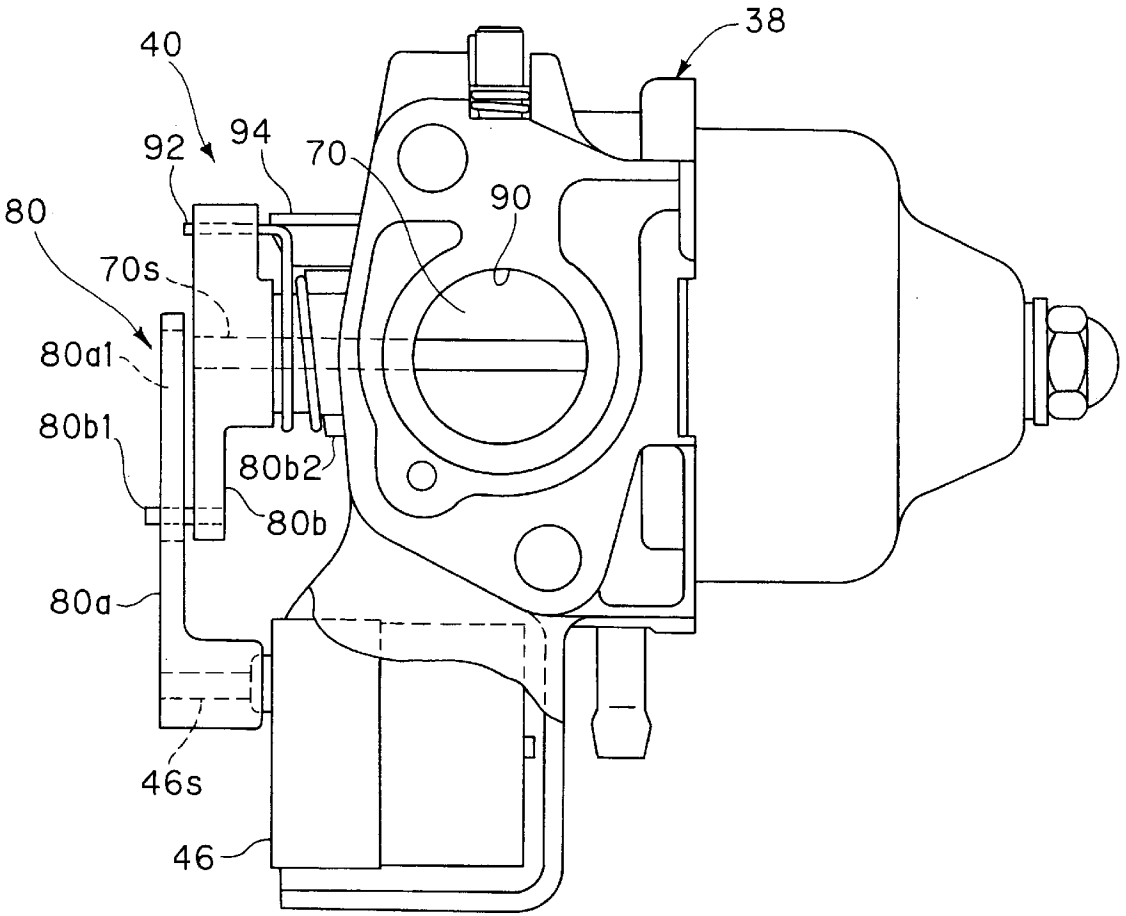
FIG. 3 is a right side view of the throttle system rated in FIG. 1.

FIG. 2 is a front view and FIG. 3 a right side view of the throttle system 40.

The throttle system 40 will now be explained with reference to these two drawings. The throttle system 40 is composed of a throttle valve 70 and an output transmission mechanism 80 constituted as a link mechanism.

The throttle valve 70 is installed midway of an intake air passage 90 (part of which is shown by a broken line) that communicates with the carburetor 38 and with the air intake passage 28 of the engine 10. The output of the motor 46 is transmitted to the throttle valve 70 through the link mechanism 80 interconnecting the two. The motor 46 is internally equipped with reduction gearing (not shown) of a constant reduction ratio and its output shaft 46*s* outputs rotational displacement reduced by the reduction gearing. In the following, the terms "motor output" (or "rotation angle θm") are used to mean this reduced rotational displacement.

The link mechanism 80 comprises a link lever 80*a* and a throttle lever 80*b*. One end of the link lever 80*a* is connected to the output shaft 46*s* and its other end is formed with an arcuate long hole 80*a*1. One end of the throttle lever 80*b* is formed with a link pin 80*b*1 and its other end is connected to a rotating shaft 70*s* of the throttle valve 70.

Figure 4:
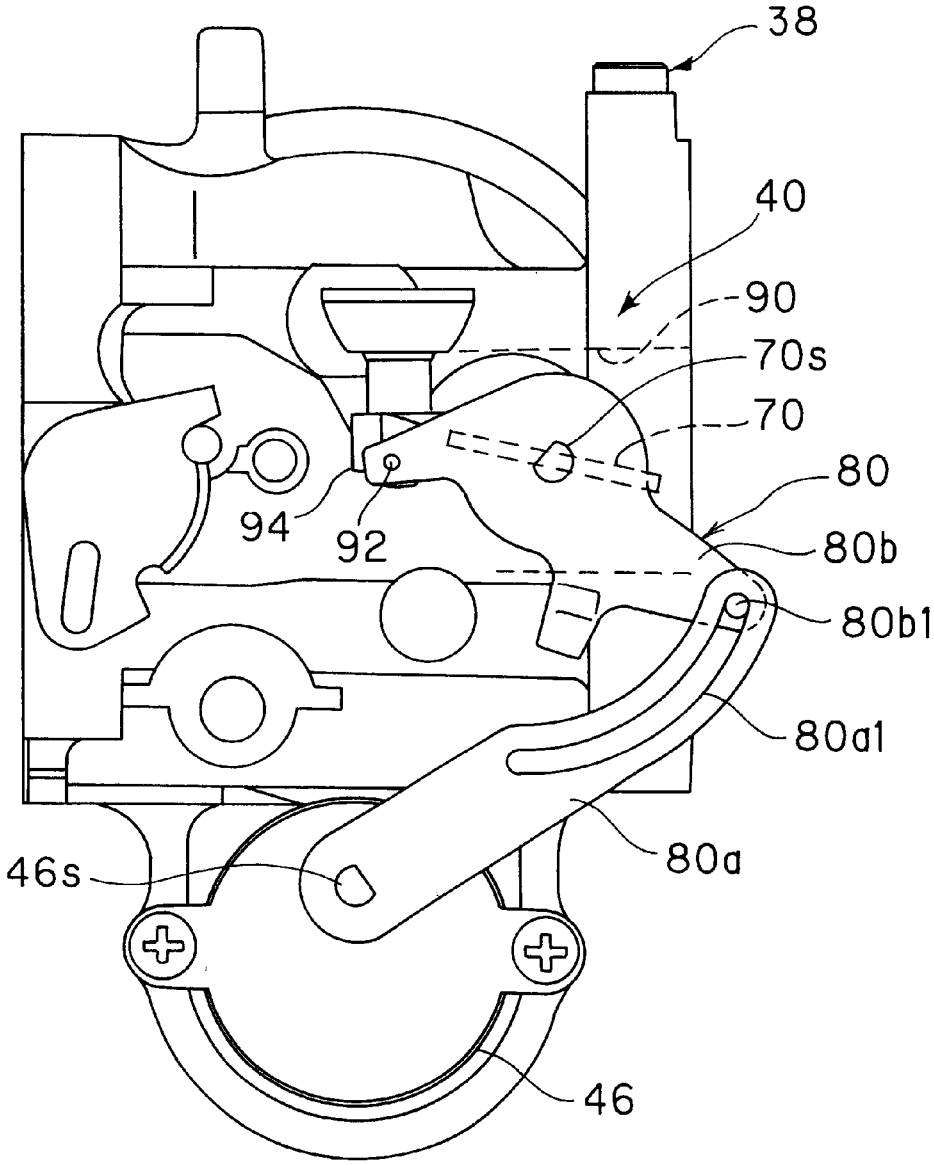
FIG. 4 is a front view of the throttle system similar to FIG. 2.

The link pin 80*b*1 of the throttle lever 80*b* is movably inserted into the long hole 80*a*1. Specifically, as shown in FIG. 4, the link lever 80*a* and the throttle lever 80*b* are connected with each other such that they can be displaced relative to each other. The displacement (rotation) output of the motor 46 is therefore transmitted to the throttle valve 70 by displacing the link lever 80*a* and throttle lever 80*b* to control the opening of the throttle valve 70 as desired. FIG.

2 shows the throttle system 40 when the throttle valve 70 is in the fully closed position (which may in practice be defined as a position a few degrees in the open direction from the totally closed (90 degree) position so as to prevent valve seizing). FIG. 4 shows the throttle valve 70 in the wide-open position.

A return spring 92 fastened to a tip portion of the throttle lever 80*b* located beyond the connection point of the rotating shaft 70*s* as viewed from the link pin 80*b*1 operates to energize the throttle valve 70 in the closing direction (in the direction of returning the link mechanism 80 from the state shown in FIG. 4 to that shown in FIG. 2). As shown in FIG. 2, when the link mechanism 80 is in the fully closed position, an abutment lug 80*b*2 provided on the throttle lever 80*b* collides with a stop 94 formed on the side face of the carburetor 38 to restrict further movement in the closing direction.

The link mechanism 80 will now be explained in further detail with reference to FIG. 5.

Figure 5:
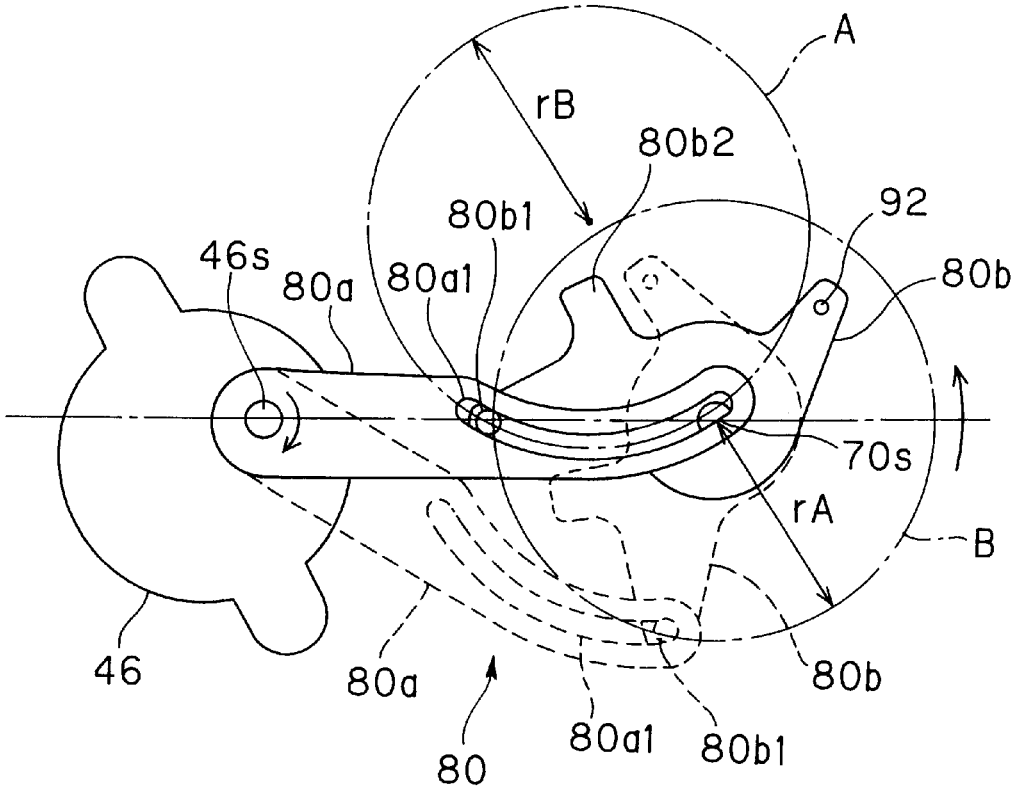
FIG. 5 is an explanatory diagram showing the operation and other aspects of a link mechanism, etc., illustrated in FIG. 1.

FIG. 5 is an explanatory diagram showing the operation and other aspects of the motor 46 and link mechanism 80. The solid-line representation shows the link mechanism 80 when the throttle valve (not shown) is at the fully closed position, and the broken-line representation shows the link mechanism 80 when the throttle valve is in the wide-open position.

As illustrated, the link mechanism 80 is configured so that the output shaft 46*s*, the link pin 80*b*1, the throttle lever 80*b* and the rotating shaft 70*s* lie on a straight line when the throttle valve is fully closed. If, when the link mechanism 80 is in this condition, the output of the motor 46 is applied to the link lever 80*a* to rotate it clockwise as viewed in the drawing, the link pin 80*b*1 will move along the long hole 80*a*1 to rotate the throttle lever 80*b* and the throttle valve rotating shaft 70*s* counterclockwise and thus drive the throttle valve in the opening direction.

From the fact that the link mechanism 80 is configured so that the output shaft 46*s*, the link pin 80*b*1, the throttle lever 80*b* and the rotating shaft 70*s* lie on a straight line when the throttle valve is fully closed, it follows that the distance between the output shaft 46*s* and the link pin 80*b*1 of the throttle lever 80*b* is shortest when the throttle valve is fully closed. And from this it follows that the displacement (rotation angle) of the throttle valve 70 in response to the displacement (rotation) output of the motor 46 is smallest (finest) when the throttle valve 70 is fully or almost fully closed. It also follows that the reduction ratio is maximum at or near fully closed.

Figure 6:
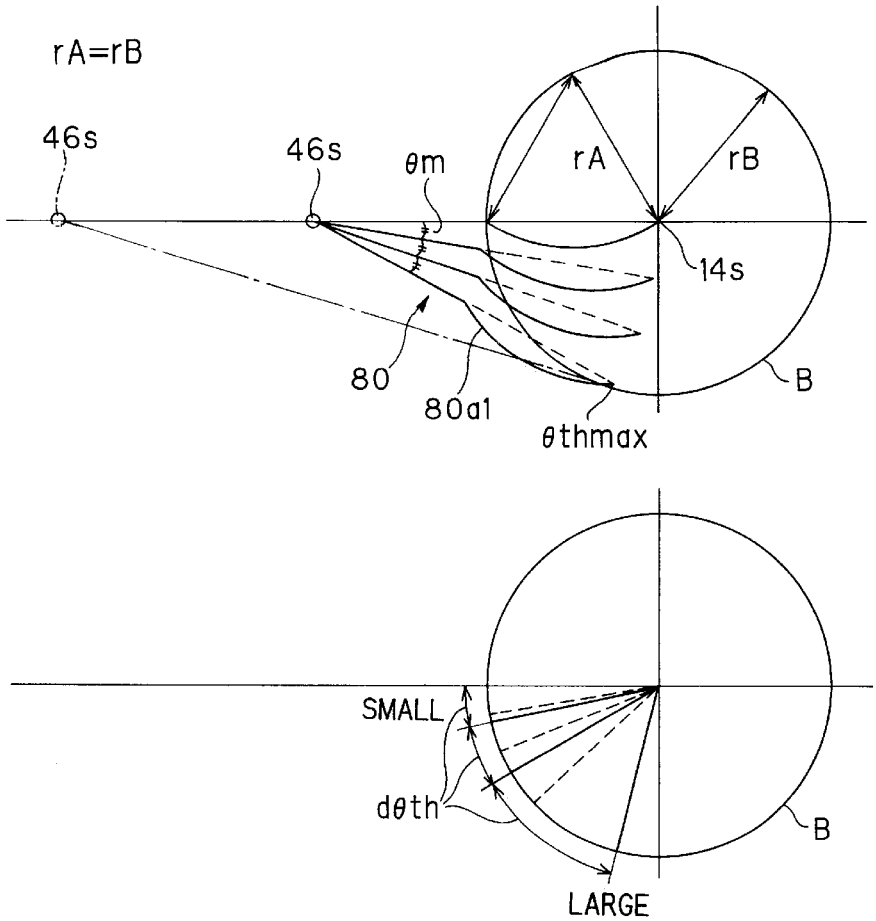
FIG. 6 is a schematic diagram showing the operation and of the link mechanism, etc., illustrated in FIG. 1.

More specifically, as shown in FIG. 6, change dθth in throttle opening θth with change dθm in motor rotation angle decreases with decreasing throttle opening and, conversely, change dθth in throttle opening θth with change dθm in motor rotation angle increases with increasing throttle opening.

Therefore, when the opening of the throttle valve 70 is small (i.e., when pressure difference between upstream and downstream of the throttle valve is large), the throttle valve 70 can be finely opened and closed. Further, when the opening of the throttle valve 70 is fully or almost fully closed, seizing of the throttle valve 70 can be prevented because the reduction ratio is maximum (throttle valve drive torque is maximum).

Moreover, when the opening of the throttle valve 70 is large (i.e., when pressure difference between upstream and downstream of the throttle valve is small), the throttle valve 70 can be opened and closed at high speed and, therefore, the engine speed control response is enhanced owing to, for example, suppression of instantaneous changes in engine speed NE with change in load (instantaneous change (rise) in engine speed with transition from a "load-on" to a "load-off" condition).

In the configuration according to this embodiment, the link lever 80*a* and the throttle lever 80*b* interconnecting the motor output shaft 46*s* and the rotating shaft 70*s* are connected by inserting the link pin 80*b*1 in the long hole 80*a*1 to be movable therein. As the degree of axial alignment required in this arrangement is substantially less severe than in the case of gear interconnection, the cost of fabrication can be reduced.

The long hole 80*a*1 is formed to have the shape of an arc defined by a circle (designated A in the FIG. 5) projecting in the direction that the throttle opening is increased. As shown in FIG. 6, the arcuately formed long hole 80*a*1 (solid line) increases the change dθth in the throttle opening over that in the case of a straight long hole 80*a*1 (broken line). By giving the link lever 80*a* an arcuate shape, therefore, it becomes possible to set the reduction ratio of the internal gearing of the motor 46 to a larger value and thus further enhance the foregoing effects.

Moreover, if a straight line were to be used to obtain an opening equal to the maximum (wide) opening θthmax by the arcuate line, it would be necessary, as shown by the alternate long and short dash line in the upper diagram of FIG. 6, to extend the link mechanism 80 (make the motor output shaft 46*s* more distant from the locus B of the link pin 80*b*1). Making the long hole 80*a*1 arcuate therefore also enables better space utilization.

The radius of curvature rA of the long hole 80*a*1 and the rotational radius of curvature rB of the link pin 80*b*1 (i.e., the radius of the arc described by the locus B of the link pin 80*b*1) are made the same in this embodiment. This enables the foregoing effects to be obtained still more markedly, as will be explained in following.

Figure 7:
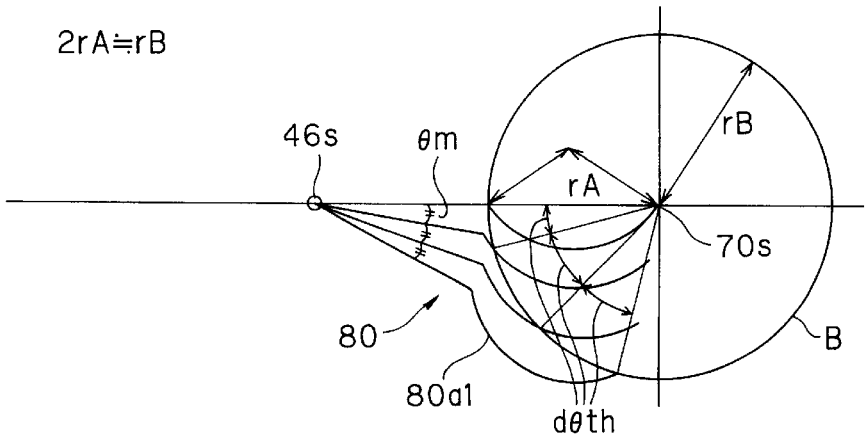
FIG. 7 is a schematic diagram showing the operation and of the link mechanism, etc., when the radius of curvature of a long hole formed in the link mechanism is changed.

FIG. 7 shows the change dθth in throttle opening when the radius of curvature rA of the long hole 80*a*1 is defined as about one half the rotational radius of curvature rB of the link pin 80*b*1. As shown in this drawing, defining the radius of curvature rA of the long hole 80*a*1 too small makes the change dθth grow smaller beyond a certain throttle opening. On the other hand, setting the radius of curvature rA of the long hole 80*a*1 too large makes it approach tangential, which is disadvantageous in terms of space utilization, and also lowers the rate at which the change dθth increases.

A throttle valve ordinarily has an opening range of about 90 degrees between fully closed and wide open (a somewhat smaller range if fully closed is defined as a position a few degrees in the open direction from the 90 degree position so as to prevent valve seizing). The inventors discovered that in the case of a throttle valve having such an opening range of about 90 degrees, the change dθth in the throttle opening can be optimally incremented from fully closed toward wide open by defining the radius of curvature rA of the long hole 80*a*1 and the rotational radius of curvature rB of the link pin 80*b*1 to be the same or substantially the same.

Figure 8:
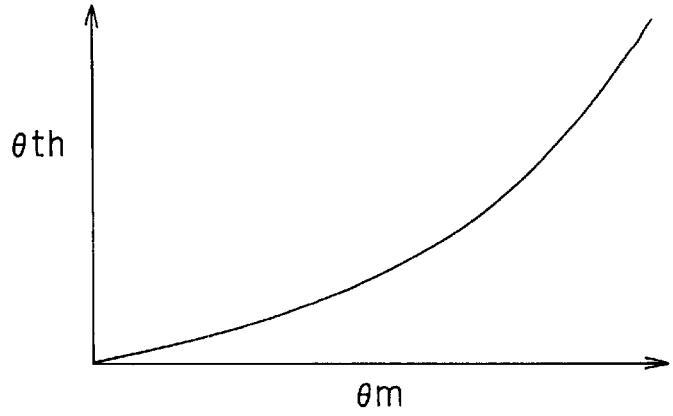
FIG. 8 is a graph showing the relationship between motor rotation angle θm and throttle opening θth of the throttle system illustrated in FIG. 1.

FIG. 8 shows how throttle opening θth varies as a function of motor rotation angle θm when the link mechanism 80 of this embodiment is used. When the relationship between throttle opening θth and motor rotation angle θm illustrated in this drawing is considered in conjunction with the relationship between throttle opening θth and amount of intake air Gair shown in FIG. 11 (i.e., the relationship between the pressure differences upstream and downstream of the throttle valve), it can be seen that the proportional relationship shown FIG. 9 can be established between motor rotation angle θm and amount of intake air Gair.

Figure 10:
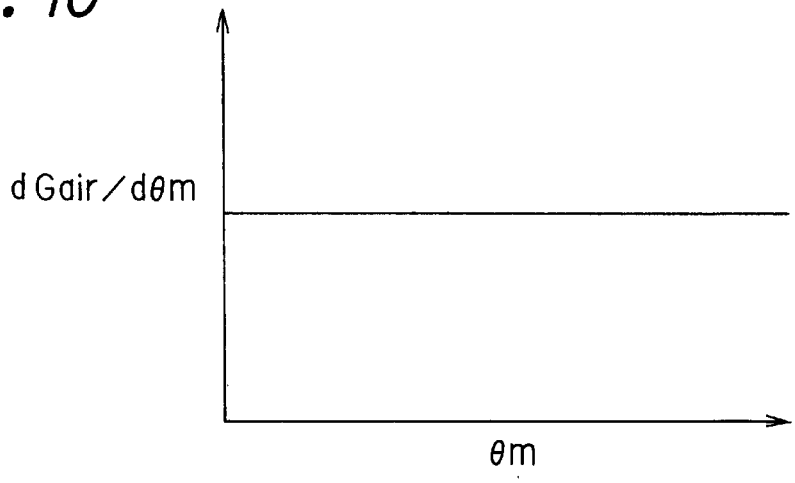
FIG. 10 is a graph showing the relationship between the motor rotation angle θm and the change in amount of intake air relative to the change in motor rotation dGair/dθm of the throttle system illustrated in FIG. 1.

More specifically, since, as shown in FIG. 10, change in amount of intake air with change in motor rotation angle θm, i.e., dGair/dθm, can be maintained constant, engine speed NE can be accurately controlled with good response regardless of throttle opening.

The dimensions of the different parts of the link mechanism 80 should be determined taking into account the output torque of the motor 46, in the same way that the reduction ratio of gearing would be determined. In the link mechanism 80 of this embodiment, the distance between the output shaft 46*s* and the rotating shaft 70*s* of the throttle valve is set at 37 mm, the length of the throttle lever 80*b* (distance from the throttle valve rotating shaft 70*s* to the link pin 80*b*1) at 18.5 mm, and the length of the link lever 80*a* (distance from the motor output shaft 46*s* to the point of contact with the link pin 80*b*1) at 18.5 mm when throttle valve is fully closed and 35.9 mm when it is wide open. As a result, the opening/closing speed at wide open (rate of change in throttle opening θth with motor rotation angle θm) is about 6.5 times that at fully closed.

This embodiment is thus configured so that the amount of displacement (rotation angle) of the throttle valve 70 relative to the displacement (rotation) of the motor 46 is smallest (finest) at or near fully closed to enable fine opening/closing when the throttle opening is small and, further, so that the throttle valve 70 can be opened/closed at high speed when the throttle opening is large. The engine speed NE can therefore be accurately controlled with excellent response irrespective of throttle opening. Other advantages include prevention of throttle valve seizing and reduced fabrication cost.

Moreover, since the long hole 80*a*1 is made arcuate and the radius of curvature rA of the long hole 80*a*1 is made the same as the rotational radius of curvature rB of the locus of the link pin 80*b*1, the foregoing effects are enhanced and the size of link mechanism 80 can be reduced for better space utilization.

Figure 13:
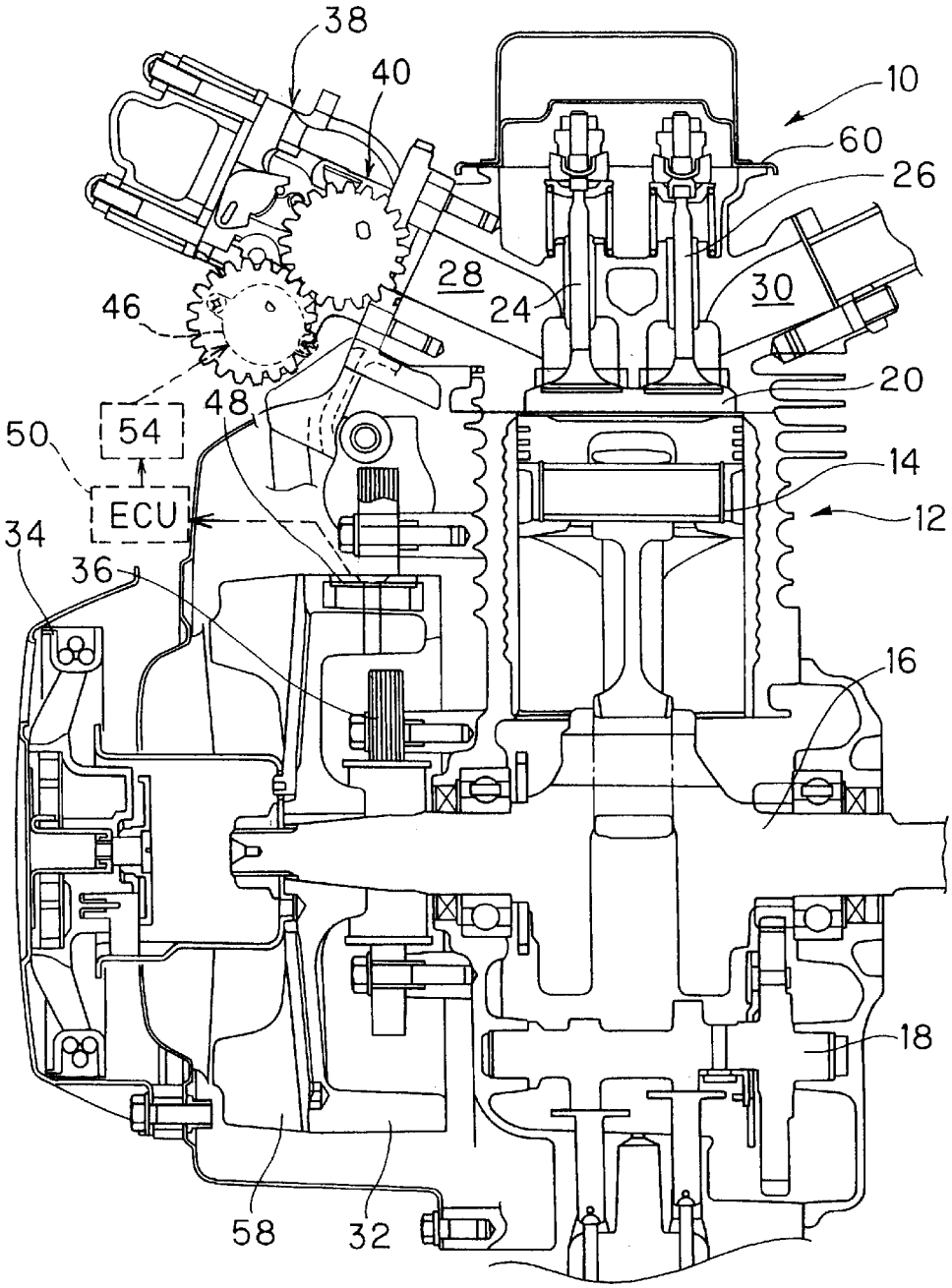
FIG. 13 is a view similar to FIG. 1, but showing a throttle system for a general-purpose engine according to a second embodiment of this invention.

FIG. 13 is a schematic diagram showing another throttle system for a general-purpose engine according to a second embodiment of this invention, together with the general-purpose engine in which it is installed.

Figure 14:
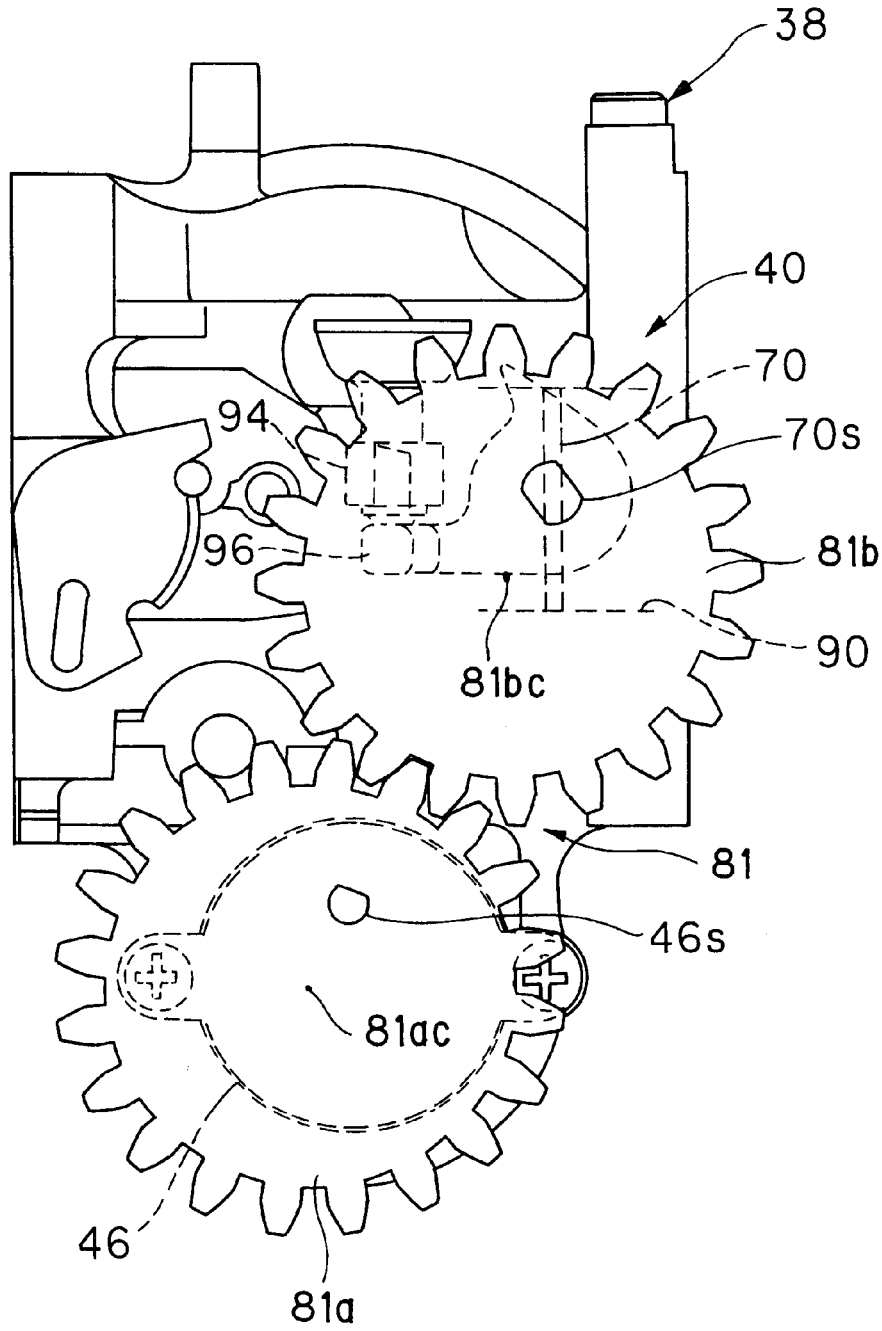
FIG. 14 is a front view of the throttle system illustrated in FIG. 13.
Figure 15:
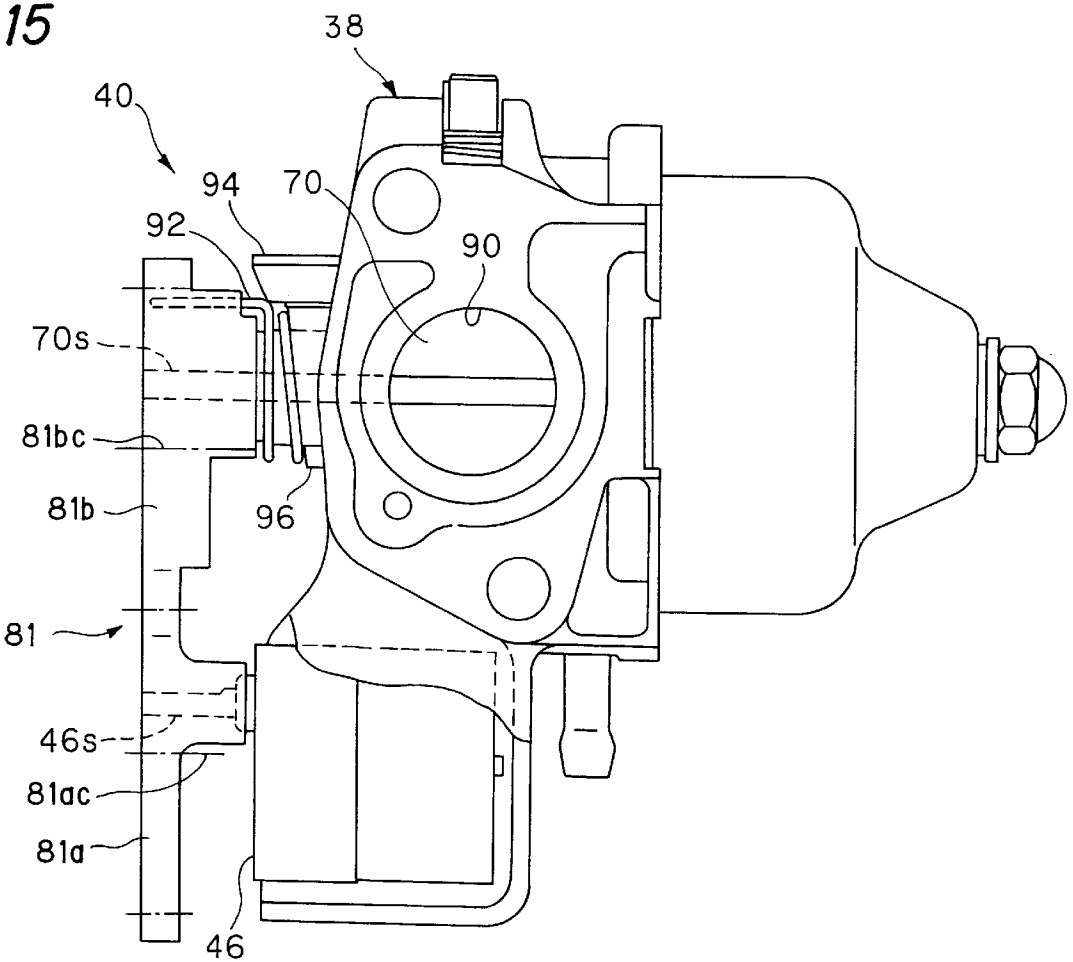
FIG. 15 is a right side view of the throttle system rated in FIG. 13.

FIG. 14 is a front view and FIG. 15 a right side view of the throttle system 40.

The throttle system 40 of this second embodiment will now be explained with reference to FIGS. 13 to 15, focusing particularly on the points of difference from the first embodiment. The throttle system 40 in the second embodiment is composed of the throttle valve 70 and an output transmission mechanism 81 which is similar to the mechanism 80 in the first embodiment, but is constituted as a gear mechanism.

The output of the motor 46 is transmitted to the throttle valve 70 through the link mechanism 81 interconnecting the two.

The gear mechanism 81 comprises a drive gear 81*a* (the first gear) and a driven gear 81*b* (the second gear) meshed therewith. The drive gear 81*a* is attached or connected to the output shaft 46*s* of the motor 46 at a location a prescribed distance apart from its gear center 81*ac*. The driven gear 81*b* is attached or connected to the rotating shaft 70*s* of the throttle valve 70 at a location a prescribed distance apart from its gear center 81*bc*. In other words, the drive gear 81*a* and driven gear 81*b* are each constituted as an eccentric gear whose axis of rotation and center do not coincide.

Figure 16:
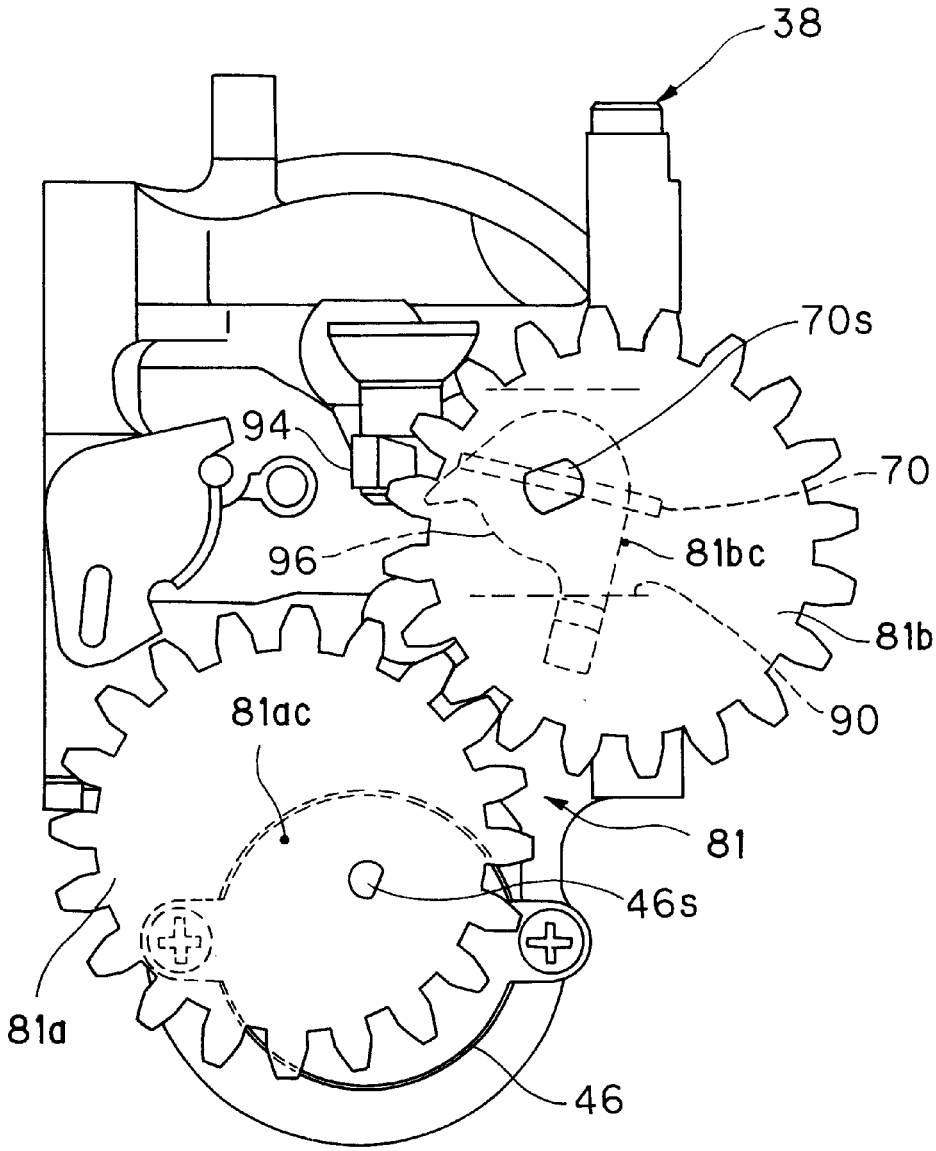
FIG. 16 is a front view of the throttle system similar to FIG. 14.

When the output of the motor 46 is applied to the drive gear 81*a* to rotate it clockwise as viewed in the drawing, the driven gear 81*b* rotates counterclockwise as viewed in the drawing to drive the throttle valve 70 in the direction of increasing the throttle opening (in the direction of the state shown in FIG. 16). FIG. 14 shows the throttle system 40 when the throttle valve 70 is in the fully closed position (which may in practice be defined as a position a few degrees in the open direction from the totally closed (90 degree) position so as to prevent valve seizing). FIG. 16 shows the throttle valve 70 in the wide-open position.

A return spring 92 (shown in FIG. 15) fastened to the driven gear 81*b* operates to energize the throttle valve 70 in the closing direction (in the direction of returning the gear mechanism 81 from the state shown in FIG. 16 to that shown in FIG. 14). As shown in FIG. 14, when the gear mechanism 81 is in the fully closed position, an abutment lug 96 joined to the rotating shaft 70*s* of the throttle valve collides with a stop 94 formed on the side face of the carburetor 38 to restrict further movement in the closing direction.

The gear mechanism 81 will now be explained with reference to FIG. 17 and on.

Figure 17:
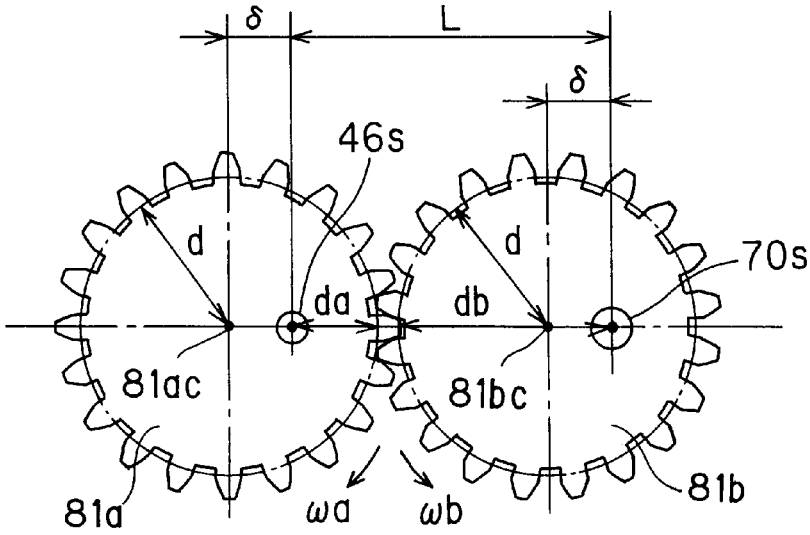
FIG. 17 is an explanatory diagram showing the operation and other aspects of an output transmission mechanism (gear mechanism), etc., illustrated in FIG. 13, when the throttle is fully closed.
Figure 18:
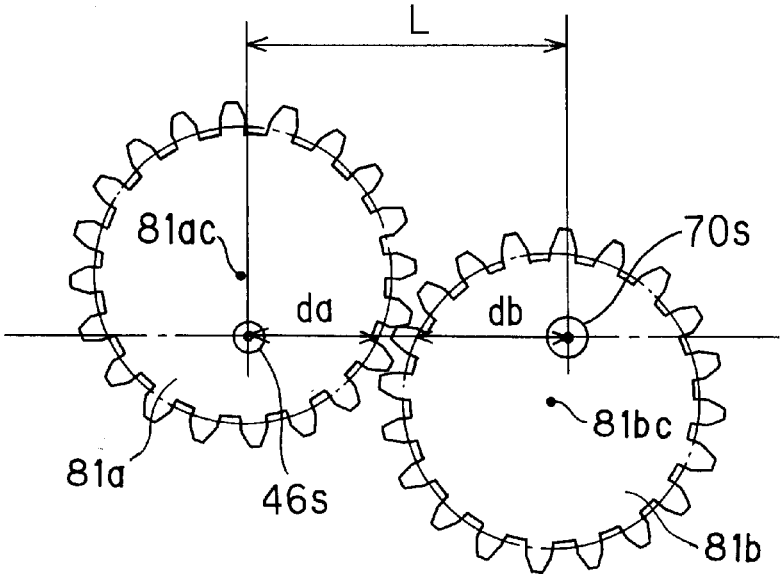
FIG. 18 is a view, similar to FIG. 17, but showing the operation the gear mechanism when the throttle is fully opened.

FIG. 17 is an explanatory diagram showing the gear mechanism 81 when the throttle valve is at the wide-open position. FIG. 18 is an explanatory diagram showing it when the throttle valve is in the fully closed position.

As shown in FIG. 17, the drive gear 81*a* and driven gear 81*b* both have a base circle of radius d and are identically shaped. The motor output shaft 46*s* is fixed to the drive gear 81*a* at a location apart from its gear center 81*ac* by distance δ in the direction toward the driven gear 81*b*. In other words, the drive gear 81*a* is decentered by distance δ. On the other hand, the rotating shaft 70*s* of the throttle valve is fixed to the driven gear 81*b* at a location apart from its gear center 81*bc* by distance δ in the direction away from the drive gear 81*a*. Thus it is also decentered.

As illustrated, the gear mechanism 81 is configured so that the gear center 81*ac,* the motor output shaft 46*s*, the gear center 81*bc,* and the rotating shaft 70*s* of the throttle valve lie on a straight line when the throttle valve is fully closed. Now, dividing the straight line connecting the output shaft 46*s* and the rotating shaft 70*s* into a line segment da delimited by the output shaft 46*s* and the base circle of the drive gear 81*a* and a second line segment db delimited by the rotating shaft 70*s* and the base circle of the driven gear 81*b,* it follows that db/da is maximum when the throttle valve is at or near fully closed. This means that the reduction ratio is maximum when the throttle valve is at or near fully closed.

On the other hand, as shown in FIG. 18, da/db and the reduction ratio decrease with increasing throttle opening. In other words, the rotation angle of the driven gear 81*b* (throttle opening θth) in response to the rotation angle of the drive gear 81*a* (motor rotation angle θm) is minimum when the throttle opening is fully or almost fully closed and increases with increasing throttle opening.

Figure 19:
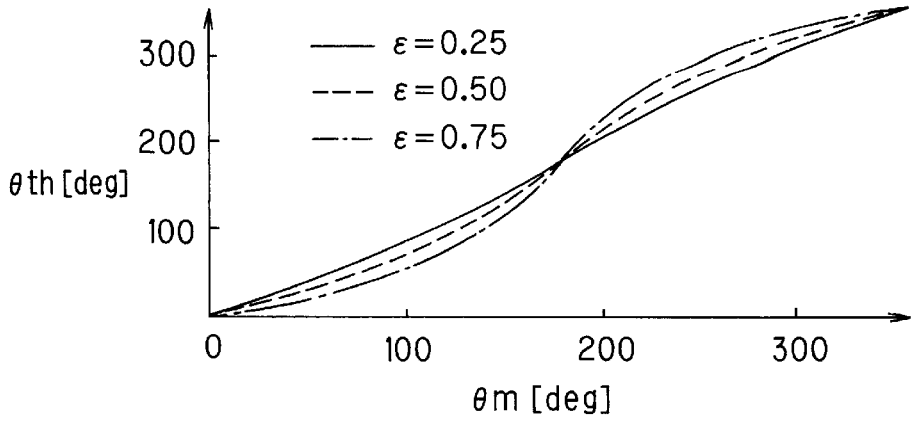
FIG. 19 is a graph showing the relationship between motor rotation angle θm and throttle opening θth of the throttle system illustrated in FIG. 13.

FIG. 19 shows how throttle opening θth varies as a function of motor rotation angle θm. The symbol ϵ in the drawing represents eccentricity defined as 2δ/L, where L is the distance between the output shaft 46*s* and the rotating shaft 70S. If the shaft-to-shaft distance L is 37.0 mm, for instance, the eccentric offset δ becomes 4.6 mm, 9.3 mm and 13.9 mm when the eccentricity ϵ is 0.25, 0.50 and 0.75.

A throttle valve ordinarily has an opening range of about 90 degrees (a somewhat smaller range if fully closed is defined as a position a few degrees in the open direction from the 90 degree position so as to prevent valve seizing).

Figure 20:
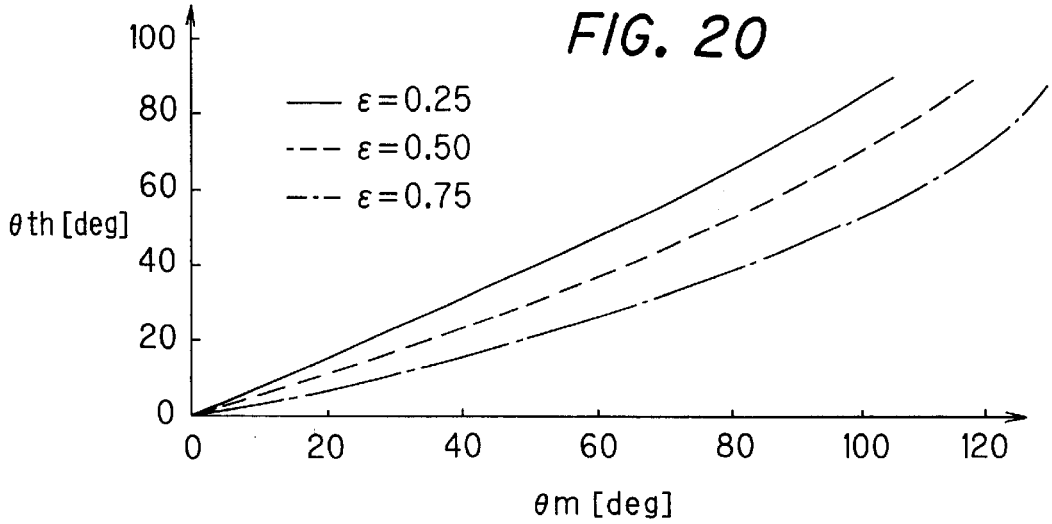
FIG. 20 is a view, similar to FIG. 18, but showing the relationship on the region where throttle opening θth is 0 to 90 degrees.
Figure 21:
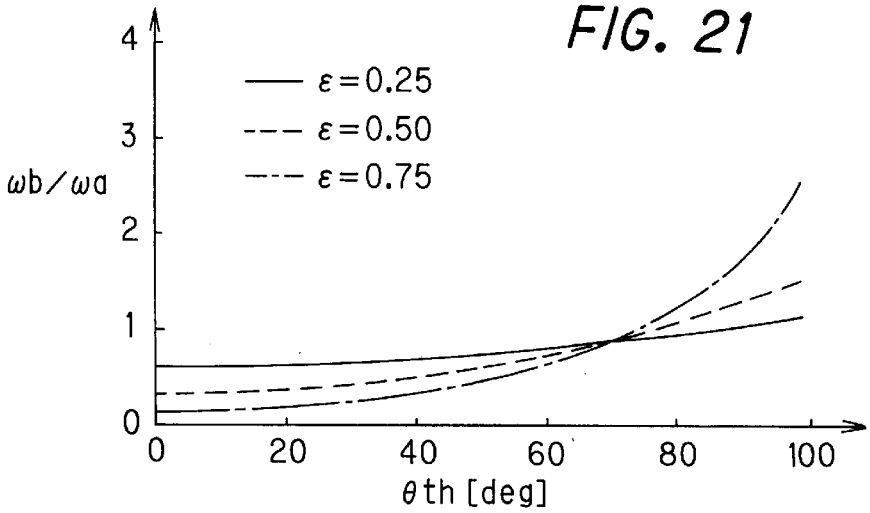
FIG. 21 is a graph showing the relationship between the throttle opening θth and an angular velocity rartio ωb/ωa of the throttle system illustrated in FIG. 13.

FIG. 20 zooms in on the region of FIG. 19 where θth is 90 degrees or less. As can be seen in FIG. 20, change (rate of increase) in throttle opening θth relative to change in motor rotation angle θm is minimum when the throttle valve is at or near fully closed. On the other hand, change (rate of increase) in throttle opening θth relative to change in motor rotation angle θm increases with increasing throttle opening θth. Moreover, the rate of increase rises with increasing eccentricity ϵ.

Where the angular velocity of the drive gear 81*a* is defined as ωa and that of the driven gear 81*b* as ωb, the angular velocity ratio ωb/ωa varies as a function of θth as shown in FIG. 21. As can be seen from FIG. 21, the opening/closing speed increases with increasing throttle opening θth. Moreover, the rate of increase rises with increasing eccentricity ϵ.

Owing to the fact that the drive gear 81*a* and driven gear 81*b* are made eccentric gears, the throttle valve 70 can be finely opened and closed when the throttle opening θth is small (i.e., when pressure difference between upstream and downstream of the throttle valve is large). Further, when the opening of the throttle valve 70 is fully or almost fully closed, seizing of the throttle valve 70 can be prevented because the reduction ratio is maximum (throttle valve drive torque is maximum).

Moreover, when the opening of the throttle valve 70 is large (i.e., when pressure difference between upstream and downstream of the throttle valve is small), the throttle valve 70 can be opened and closed at high speed and, therefore, the engine speed control response is enhanced owing to, for example, suppression of instantaneous changes in engine speed NE with change in load (instantaneous change (rise) in engine speed with transition from a "load-on" to a "load-off" condition).

Figure 9:
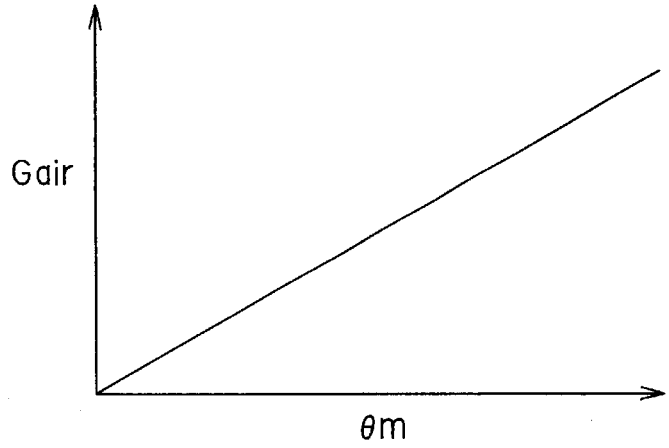
FIG. 9 is a graph showing the relationship between the motor rotation angle θm and amount of intake air Gair of the throttle system illustrated in FIG. 1.
Figure 11:
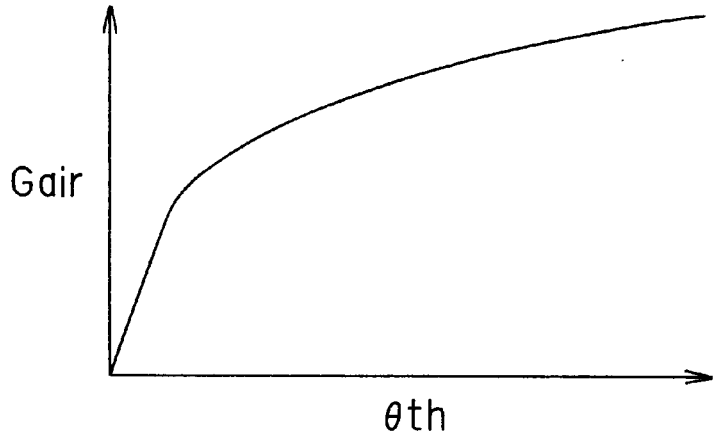
FIG. 11 is a graph showing the relationship between amount of intake air Gair and the throttle opening θth.
Figure 12:
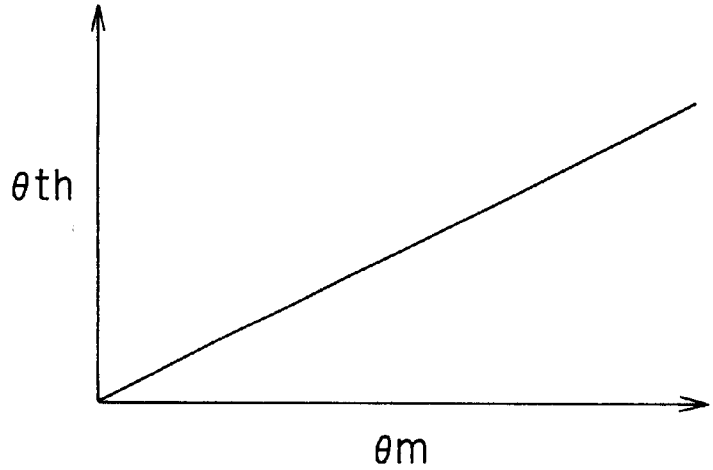
FIG. 12 is a graph showing the relationship between motor rotation angle θm and the throttle opening θth in the prior art system.

When the relationship between throttle opening θth and motor rotation angle θm shown in FIG. 20 is considered in conjunction with the relationship between throttle opening θth and amount of intake air Gair shown in FIG. 11, it can be seen that the same proportional relationship as shown FIG. 9 can be established between motor rotation angle θm and amount of intake air Gair.

Thus also in this second embodiment, since, as shown in FIG. 10, change in amount of intake air with change in motor rotation angle θm, i.e., dGair/dθm, can be maintained constant, engine speed NE can be accurately controlled with good response regardless of throttle opening.

As explained in the foregoing, change in throttle opening θth relative to change in motor rotation angle θm increases with increasing eccentricity ϵ. It therefore becomes possible to set the reduction ratio of the internal gearing of the motor 46 to a larger value and thus further enhance the foregoing effects.

A throttle system for a general-purpose engine that is a third embodiment of this invention will now be explained with reference to FIGS. 22 to 24.

Figure 22:
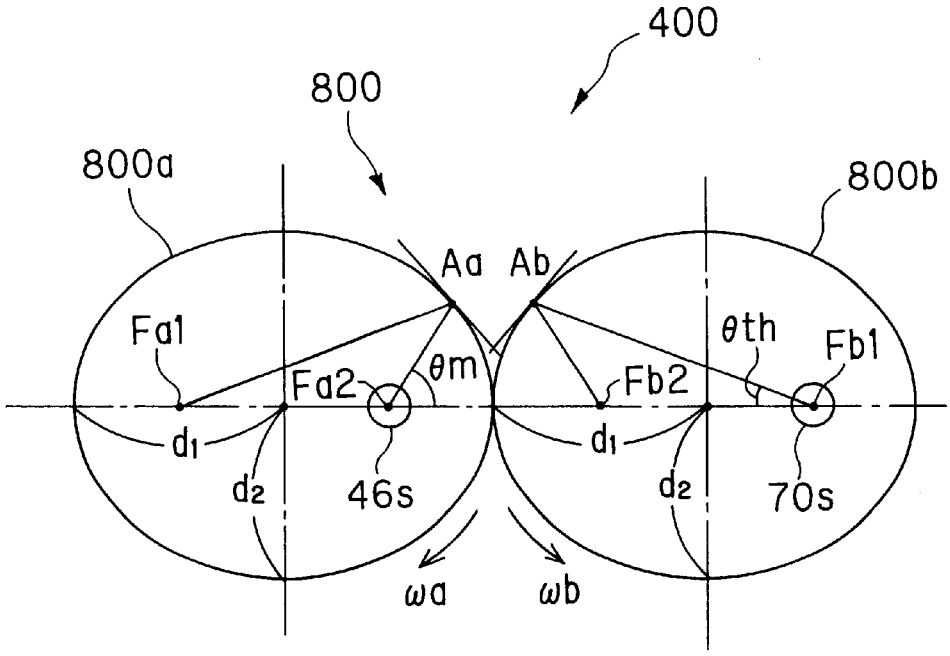
FIG. 22 is an explanatory diagram showing an output transmission mechanism (gear mechanism) of a throttle system for a general-purpose engine according to a third embodiment of this invention.

As shown in FIG. 22, the throttle system 400 of the third embodiment comprises an output transmission mechanism 800 also constituted as a gear mechanism which is composed of a drive gear 800*a* and a driven gear 800*b*, which are identically shaped elliptic gears having a major axis radius d1 and a minor axis radius d2.

To facilitate a concrete explanation, the focus of the drive gear 800*a* farther from the driven gear 800*b* is defined as Fa1 and the focus thereof closer to the driven gear 800*b* is defined as Fa2. The motor output shaft 46*s* is situated at the closer focus Fa2. Further, the focus of the driven gear 800*b* farther from the drive gear 800*a* is defined as Fb1 and the focus thereof closer to the drive gear 800*a* is defined as Fb2. The rotating shaft 70*s* is situated at the farther focus Fb1.

FIG. 22 shows the gear mechanism 800 when the throttle valve is in the fully closed position. As illustrated, the gear mechanism 800 is configured so that the foci Fa1, Fa2, Fb1 and Fb2, the motor output shaft 46*s*, and the rotating shaft 70*s* of the throttle valve lie on a straight line when the throttle valve is fully closed.

Defining the angular velocity of the drive gear 800*a* as ωa and that of the driven gear 800*b* as ωb, it follows that $$\omega a \rho a = \omega b \rho b,$$

where ρa is a line segment between an arbitrary point Aa on the ellipse of the drive gear 800*a* and the focus Fa2, and ρb is a line segment between a point Ab on the ellipse of the driven gear 800*b* that is symmetrical to the point Aa and the focus Fb2.

In the throttle opening region between fully closed and wide open, i.e., the region of θth between 0 and 90 degrees, ρa increases and ρb decreases with increasing θth. From the relation between ωa and ωb expressed by the foregoing equation, therefore, it can be seen that the reduction ratio (speed ratio) between the drive gear 800*a* and driven gear 800*b* is maximum when the throttle opening is at or near fully closed and decreases with increasing throttle opening. In other words, it can be seen that the rotation angle of the driven gear 800*b* (throttle opening θth) in response to the rotation angle of the drive gear 800*a* (motor rotation angle θm) is minimum when the throttle opening is fully or almost fully closed and increases with increasing throttle opening.

Figure 23:
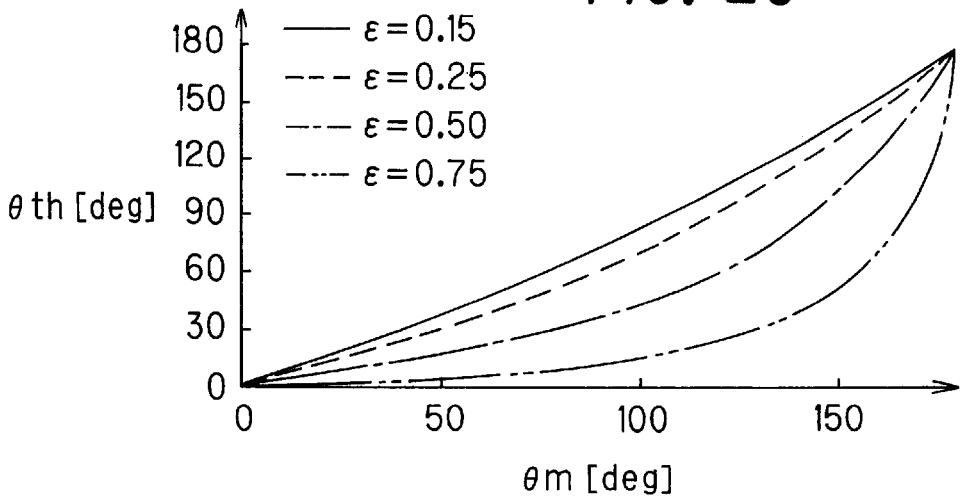
FIG. 23 is a graph showing the relationship between motor rotation angle θm and throttle opening θth of the throttle system illustrated in FIG. 22.
Figure 24:
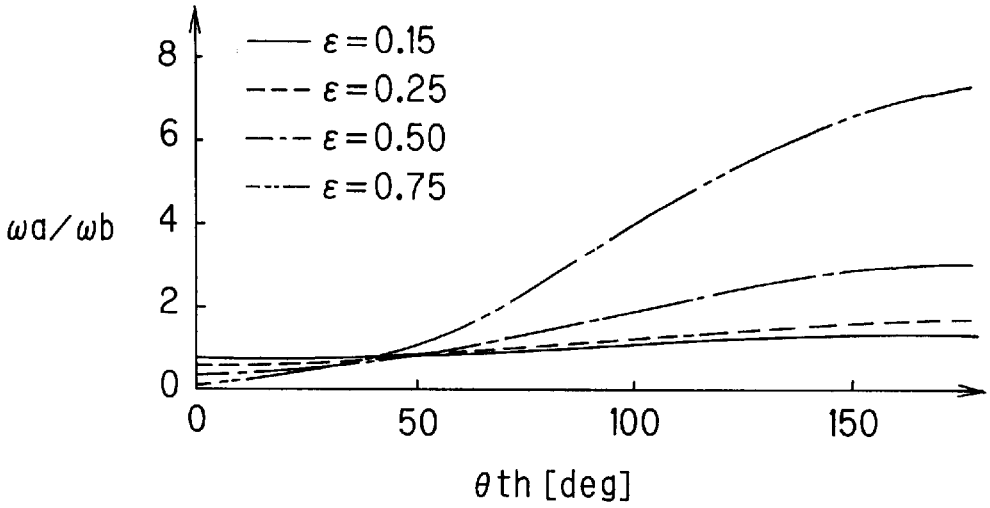
FIG. 24 is a graph showing the relationship between the throttle opening θth and an angular velocity rartio ωb/ωa of the throttle system illustrated in FIG. 22.

FIG. 23 shows how throttle opening θth varies as a function of motor rotation angle θm in the third embodiment. As can be seen in FIG. 23, change (rate of increase) in throttle opening θth relative to change in motor rotation angle θm is minimum when the throttle valve is at or near fully closed. On the other hand, change (rate of increase) in throttle opening θth relative to change in motor rotation angle θm increases with increasing throttle opening θth. Moreover, the rate of increase rises with increasing eccentricity ϵ. Eccentricity ϵ is defined as $\epsilon=[(d1)^2-(d2)^2]^{1/2}/d1$.

Where the angular velocity of the drive gear 800*a* is defined as ωa and that of the driven gear 800*b* as ωb, the angular velocity ratio ωb/ωa varies as a function of θth as shown in FIG. 24. As can be seen from FIG. 24, the opening/closing speed increases with increasing throttle opening θth. Moreover, the rate of increase rises with increasing eccentricity ϵ.

Owing to the fact that the drive gear 81*a*, 800*a* and driven gear 81*b*, 800*b* are made eccentric gears, the throttle valve 70 can be finely opened and closed when the opening of the throttle valve 70 is small. Further, when the opening of the throttle valve 70 is fully or almost fully closed, seizing of the throttle valve 70 can be prevented because the reduction ratio is maximum.

Moreover, when the opening of the throttle valve 70 is large, the throttle valve 70 can be opened and closed at high speed and, therefore, engine speed NE can be accurately controlled with good response regardless of throttle opening.

Other aspects of throttle system according to the third embodiment are the same as those of the second embodiment and will not be explained again here. Also as in the second embodiment, a larger eccentricity ϵ enables the reduction ratio of the internal gearing of the motor 46 to be set to a larger value to further enhance the foregoing effects.

Thus, the throttle systems of the second and third embodiments are configured so that the output of the motor 46 is transmitted to the throttle valve 70 through the gear mechanism 81, 800, the gear mechanism 81, 800 is composed of eccentric gears or elliptical gears, and the rotation angle of the driven gear 81*b*, 800*b* (throttle opening θth) relative to the rotation angle of the drive gear 81*a*, 800*a* (motor rotation angle θm) becomes minimum when the throttle valve 70 is at or near fully closed and increases with increasing throttle opening. As in the first embodiment, therefore, the opening of the throttle valve 70 can be can finely opened and closed when the opening is small and be opened and closed at high speed when the opening is large, thereby enabling the engine speed NE to be accurately controlled with good response regardless of throttle opening. In addition seizing of the throttle valve can be prevented.

Having been configured in the foregoing manner, the first to third embodiments are configured to have a throttle system for a general-purpose engine (10), having an actuator (stepper motor 46) connected to a throttle valve (70) of the engine, the actuator being displaceable to open or close the throttle valve so as to regulate amount of intake air, characterized in that: an output transmission mechanism (80, 81, 800) is provided between the actuator (46) and the throttle valve (70) to transmit an output of the actuator to the throttle value such that an output of the mechanism relative to the output of the actuator when the throttle valve is closed, i.e., is fully closed or almost fully closed is smaller than that when the throttle value is not fully closed or not almost fully closed.

With this, this invention can provide a throttle system for a general-purpose engine in which an output transmission mechanism for transmitting the displacement output of an actuator to a throttle valve is structured so that its displacement in response to the displacement output of the actuator is minimum when the throttle valve is fully or almost fully closed. As a result, the throttle opening can be finely regulated (opened/closed) when the throttle opening is small and can be opened/closed at high speed when the throttle opening is large. In addition, seizing of the throttle valve can be prevented.

In the system, the output transmission mechanism (80) is constituted as a link mechanism (80) having; a link lever (80*a*) connected to an output shaft (46*s*) of the actuator (46); and a throttle lever (80*b*) whose one end is connected to the link lever to be displaceable relative to the link lever and whose other end is connected to a rotating shaft (70*s*) of the throttle valve (70); wherein the link lever (80*a*) and the throttle lever (80*b*) are connected to transmit the output of the actuator to the throttle value such that displacement of the mechanism relative to the output of the actuator is minimum when the throttle valve is closed, i.e., is fully closed or almost fully closed.

With this, like that mentioned above, it enables the throttle opening to be finely regulated (opened/closed) when the throttle opening is small and to be opened/closed at high speed when the throttle opening is large, while also preventing throttle valve seizing.

In the system, the throttle lever (80*b*) is formed with a link pin (80*b*1) that is movable in a hole (80*a*1) formed at the link lever, and the hole (80*a*1) is an arcuate hole having a same radius of curvature as a rotational radius of curvature of a locus of the link pin (80*b*1). Thus, this invention can provide a throttle system for a general-purpose engine that even more markedly achieves the foregoing effects, that by enabling the link lever and the throttle lever to be made small enhances space utilization efficiency, and that by eliminating the need for strict axial alignment between the motor output shaft and the throttle valve enables fabrication at lower cost than when utilizing gear interconnection.

In the system, the output transmission mechanism is constituted as a gear mechanism (81, 800) having; a first gear (81*a*, 800*a*) connected to an output shaft (46*s*) of the actuator (46); and a second gear (81*b*, 800*b*) connected to a rotating shaft (70*s*) of the throttle valve (70); wherein the first gear (81*a*, 800*a*) and the second gear (81*b*, 800*b*) are meshed together such that a rotation angle of the second gear relative to a rotation angle of the first gear is minimum when the throttle valve (70) is fully closed or almost fully closed.

With this, this invention can also provide a throttle system for a general-purpose engine in which the displacement output of an actuator is transmitted to a throttle valve through a first gear and a second gear and the rotation angle of the second gear relative to the rotation angle of the first gear is minimum, i.e., the reduction ratio is maximum, when the throttle valve is at or near fully closed. As a result, the throttle valve can be finely regulated (opened/closed) when the throttle opening is small and can be opened/closed at high speed when the throttle opening is large. In addition, seizing of the throttle valve can be prevented.

In the system, the output shaft (46*s*) of the actuator (46) is connected to the first gear (81*a*, 800*a*) at a location apart from a center (81*ac*) of the first gear (81*a*, 800*a*), and the rotating shaft (70*s*) of the throttle valve (70) is connected to the second gear (81*b*, 800*b*) at a location apart from a center (81*bc*) of the second gear (81*b*, 800*b*). More specifically, the first and second gears are eccentric gears, or the first and second gears are elliptic gears. With this, similarly, therefore, the throttle valve can be finely opened/closed when the throttle opening is small and can be opened/closed at high speed when the throttle opening is large. In addition, seizing of the throttle valve can be prevented.

The entire disclosure of Japanese Patent Application Nos. 2002-117375 and 2002-117376 both filed on Apr. 19, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A throttle system for a general-purpose engine, having an actuator connected to a throttle valve of the engine, the actuator being displaceable to open or close the throttle valve so as to regulate amount of intake air, comprising:

an output transmission mechanism provided between the actuator and the throttle valve to transmit an output of the actuator to the throttle value such that an output of the mechanism relative to the output of the actuator when the throttle valve is closed is smaller than that when the throttle valve is not closed.

2. A throttle system according to claim 1, wherein the output transmission mechanism is constituted as a link mechanism having;

a link lever connected to an output shaft of the actuator; and a throttle lever whose one end is connected to the link lever to be displaceable relative to the link lever and whose other end is connected to a rotating shaft of the throttle valve;

wherein the link lever and the throttle lever are connected to transmit the output of the actuator to the throttle value such that displacement of the mechanism relative to the output of the actuator is minimum when the throttle valve is closed.

3. A throttle system according to claim 2, wherein the throttle lever is formed with a link pin that is movable in a hole (80*a*1) formed at the link lever.

4. A throttle system according to claim 3, wherein the hole is an arcuate hole having a same radius of curvature as a rotational radius of curvature of a locus of the link pin.

5. A throttle system according to claim 1, wherein the output transmission mechanism is constituted as a gear mechanism having;

a first gear connected to an output shaft of the actuator; and a second gear connected to a rotating shaft of the throttle valve;

wherein the first gear and the second gear are meshed together such that a rotation angle of the second gear relative to a rotation angle of the first gear is minimum when the throttle valve is closed.

6. A throttle system according to claim 5, wherein the output shaft of the actuator is connected to the first gear at a location apart from a center of the first gear, and the rotating shaft of the throttle valve is connected to the second gear at a location apart from a center of the second gear.

7. A throttle system according to claim 6, wherein the first and second gears are eccentric gears.

8. A throttle system according to claim 6, wherein the first and second gears are elliptic gears.

9. A throttle system according to claim 7, wherein the first and second gears are elliptic gears.

* * * * *